US005872325A

United States Patent [19]

Feldmeier et al.

[11] Patent Number: 5,872,325

[45] Date of Patent: Feb. 16, 1999

[54] AMMUNITION CASING OF COMPOSITE FIBER MATERIAL

[75] Inventors: Herwig Feldmeier, March; Klaus Hieke, Neuenburg/Baden, both of Germany

[73] Assignee: Buck Werke GmbH & Co., Bad Ueberkingen, Germany

[21] Appl. No.: 785,787

[22] Filed: Jan. 21, 1997

[30] Foreign Application Priority Data

Jan. 24, 1996 [DE] Germany ..... 196 02 422.6

[51] Int. Cl.[6] ..... F42B 12/48; F42B 3/00

[52] U.S. Cl. ..... 102/334; 102/331; 102/431; 102/465; 102/284

[58] Field of Search ..... 102/284, 331, 102/431, 465, 334

[56] References Cited

U.S. PATENT DOCUMENTS

| | | | |
|---|---|---|---|
| H1049 | 5/1992 | Khadduri et al. . | |
| 3,513,776 | 5/1970 | Driscoll | 102/38 |
| 3,765,177 | 10/1973 | Ritchey et al. | 102/531 X |
| 4,756,248 | 7/1988 | Sato | 102/287 |
| 4,759,824 | 7/1988 | Müller et al. | 162/396 |
| 5,101,731 | 4/1992 | Adams | 102/290 |
| 5,323,707 | 6/1994 | Norton et al. | 102/431 |
| 5,495,807 | 3/1996 | Klober et al. | 102/289 |

FOREIGN PATENT DOCUMENTS

| | | |
|---|---|---|
| 19 18 163 | 10/1969 | Germany . |
| 16 21 806 | 9/1971 | Germany . |
| 35 46 489 | 8/1987 | Germany . |

OTHER PUBLICATIONS

"Die verbrennbare Kartusche" *Wehrtechnik,* Aug. 1970, pp. 357–362.

*Primary Examiner*—Peter A. Nelson
*Attorney, Agent, or Firm*—Hill & Simpson

[57] ABSTRACT

The invention is directed to an ammunition casing made of a composite fiber material, which comprises fiber material and a bonding agent, is at least partially flammable and has a high strength. The ammunition casing is particularly useful when surrounding a smoke screen unit, and the combustion reaction products of the composite fiber material form soot particles, preferably of hydrocarbon $C_XH_Y$, which will contribute to the smoke screen effect of the smoke screen unit during combustion.

20 Claims, 1 Drawing Sheet

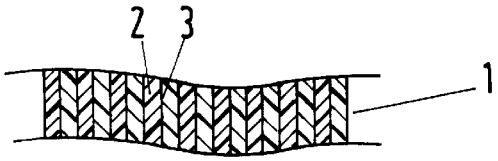
Fig.1
Fig.2
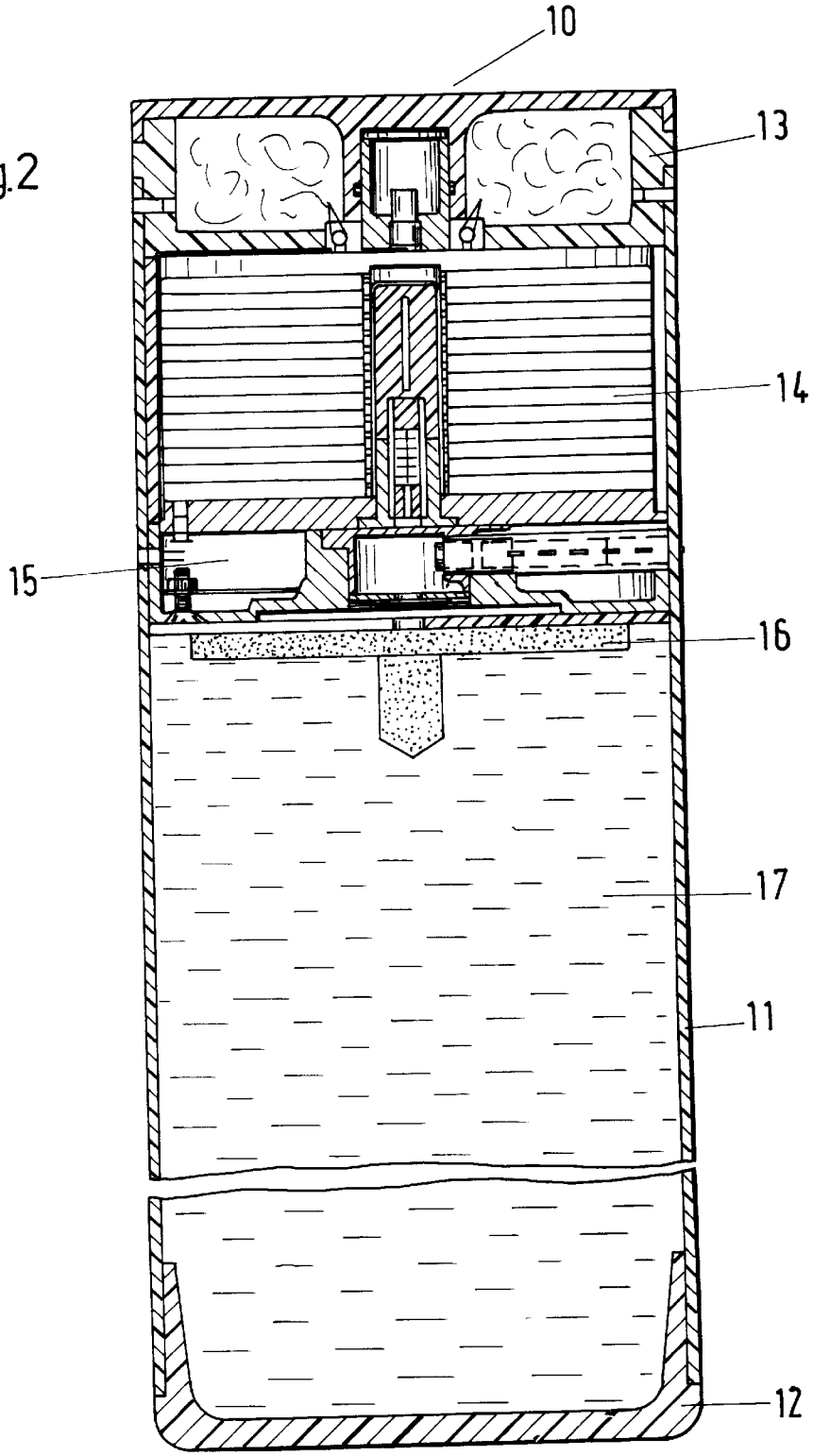

AMMUNITION CASING OF COMPOSITE FIBER MATERIAL

BACKGROUND OF THE INVENTION

The present invention is directed to an ammunition casing or cartridge casing made of a composite fiber material, which material comprises fiber materials and a bonding agent and which composite fiber material is at least partially flammable and has a high degree of strength.

Ammunition casings, which use essentially two different fiber materials, are known. U.S. Pat. No. 3,513,776, whose disclosure is incorporated herein by reference thereto and which was the basis for German Offenlegungsschrift 19 18 163, discloses the use of a mixture, which is made of a flammable propellant, which also functions as a type of bonding agent, and fibers made of carbon that are manufactured by carbonizing spun or woven textile fibers. These pure carbon fibers have a high strength up to a temperature of 2500° and, thus, cannot in themselves burn at lower temperatures. In addition, for example, on the other hand, an ammunition casing of this type is known from U.S. Pat. No. 4,759,824, whose disclosure is incorporated herein by reference thereto, and from German Patent 35 46 489. In these two references, fiber material comprises cellulose nitrate, which will burn spontaneously without producing smoke, even in the absence of oxygen. Since cellulose nitrate is subject to explosive laws, for safety reasons, its processing can only occur with aqueous slurries, which increases the processing costs.

It is also well known to use a smoke screen unit as ammunition, wherein the smoke screen unit is contained in a vessel or canister, which is, up to now, made of steel or aluminum casings, and which casings themselves do not burn and, thus, have no direct influence on the combustion behavior. However, during combustion of a smoke screen unit with such a metal casing or canister, there are disadvantages in that it is known as a chimney effect, which causes a pulsating combustion of the smoke screen unit. Long ammunition casings can, in particular, be regarded as chimneys, whereby the particles produced during combustion of the smoke screen unit are deposited on the inner wall of the ammunition casing, and thus cause a short-term blockage, whereby the blockage can only be blown out again by means of the pressure that occurs during combustion and then builds up due to the blockage. By means of this combustion that pulsates due to the temporary blockage of the ammunition casing, the dynamics of the combustion is complicated in such a way that it is essentially impossible to make any statements concerning the effectiveness of the particles that occur during combustion, and a uniform, regular smoke reaction does not occur.

SUMMARY OF THE INVENTION

The object of the present invention is to provide an ammunition casing of this type in such a way that it is suited for a smoke screen unit and overcomes the disadvantages of the prior art; in particular, a casing which has means for promoting uniform smoke screen effect.

To accomplish this goal, the ammunition casing or canister is characterized in that the canister surrounds a smoke screen unit, and the combustion reaction product of the fiber composite material comprises soot particles, in particular in the for of hydrocarbons $C_XH_Y$, which will contribute to the smoke screen effect of the smoke screen unit during combustion.

Preferably, the invention has the $C_XH_Y$ with X>>Y. The hydrocarbon occurs at a combustion temperature of the smoke screen in a range of 1500° to 2500° C. Preferably, the temperature is 2200° C.

The invention additionally proposes that the density of the fiber material is in a range of 1.1 to 1.8 g/cm$^3$. Preferably, the density is 1.36 g/cm$^3$.

It is also inventively proposed that the density of the bonding agent is in a range of 1.0 to 1.3 g/cm$^3$ and preferably is 1.15 g/cm$^3$.

In addition, it is preferred that the strength of the fiber material is between 0.8 and 3.0 kN/mm$^2$ and preferably is 1.5 kN/mm$^2$.

It can be inventively provided that the ratio of the fiber material to the bonding agent is selected so that the fiber material is in a range of 40 to 70 volume % of the total volume. Preferably, the range is 57 to 59 volume %.

An exemplary embodiment of the invention is characterized in that the fiber material comprises material selected from a group consisting of aramide, carbon fibers and carbon fibers doped with FeO.

It is also provided that the fibers of the fiber material have a cross sectional diameter in a range of 30 to 60 $\mu$m and preferably the diameter is 50 $\mu$m.

The invention additionally proposes that the fiber material can be wound with a round-wind, a criss-cross winding or a winding producing a mesh of material. In one embodiment, the bonding agent comprises an epoxy resin.

The invention is also based on the surprising finding that through the use of a suitable fiber material for a smoke screen element casing, preferably comprising aramide fibers and epoxy resin bonding agent, on the one hand, the casing will burn during the combustion of the smoke screen unit contained by them, but also, the means of the casing ensures a uniform combustion of the smoke screen unit, since a chimney effect is prevented by the burning of the casing and, moreover, the casings themselves actively contribute to the formation of the smoke.

In addition, it is also advantageous that in an inventive ammunition or cartridge casing, which, just as with a conventional metal casing, does not directly influence the combustion of a smoke screen unit, there is, however, a clear weight reduction in comparison with a conventional metal casing, so that, for example, larger effective mass portions can be installed in an ammunition casing essentially without changing the flight characteristics.

Other advantages and features of the invention will be readily apparent from the following description of the preferred embodiments, the drawings and claims.

BRIEF DESCRIPTION OF THE DRAWINGS

FIG. 1 is a partial cross sectional view through a composite fiber material of the inventive ammunition casing; and FIG. 2 is a cross sectional view through a sub-unit of a smoke screen missile that uses the inventive casing.

DESCRIPTION OF THE PREFERRED EMBODIMENTS

As illustrated in FIG. 1, a composite fiber material 1 comprises fiber materials 2 and a bonding agent 3. The fiber of the fiber materials is wound and embedded in the bonding agent 3.

It has proven particularly advantageous to use aramide as the fiber material 2, which has a strength of 1.5 kN/mm$^2$ and a density of 1.36 g/cc. It is additionally preferred to use an epoxy resin with a density of 1.15 g/cc as the bonding agent 3, whereby the ratio of the fiber material 2 to the bonding agent 3 is selected so that the fiber material 2 is preferably 57 to 59 volume % of the total volume. A composite fiber material 1 with this composition yields a combustion reaction product of $C_XH_Y$ with X>>Y, and will thus yield soot particles and burn slowly due to its good flame resistance, so that a smoke screen can be produced for several minutes during the burning of the ammunition casing 11 using this composite fiber material 1, dependent on the dimensions of the casing 11.

A sub-ammunition or container 10 of a smoke screen missile is shown in FIG. 2. This sub-ammunition 10 comprises an inventive ammunition casing 11, to which are connected a base 12 at the lower end and a landing system 13 at the upper end. In the ammunition casing 11 directly underneath the landing system 13 is arranged a first smoke screen component 14, under which is arranged an ejection charge 15. Under the ejection charge is an ignition charge 16 and, finally, a second smoke screen component 17 is arranged between the ignition charge 16 and the base 12.

This sub-ammunition unit 10 is used as follows:

In a first step, the unit 10 is inserted into a warhead (not shown), from which it can be ejected through the initiation of an ignition system of the warhead, which is not shown.

The initiated ignition system of the warhead ignites the ignition charge 16, which, on the one hand, activates the ejection charge 15, which, in turn, activates a first smoke screen component 14 and causes a relative motion between the first smoke screen component 14 and the second smoke screen component 17. In addition, the ignition charge 16 will activate the second smoke screen component 17.

Correspondingly, the first smoke screen component 14, together with the landing system arranged above it, will be separated from the casing 11, and by means of the ignition, the burning of the two smoke screen units 14 and 17, as well as the ammunition casing 11, is started. The smoke thereby occurs through the burning of the first smoke screen unit 14, the second smoke screen unit 17 and the casing 11, and this will continue until these three components 11, 14 and 17 have been completely burned.

Thus, a smoke screen of the form desired can be produced for the desired time by means of a suitable choice of a combination of materials comprising, for example, anthraquinone, as well as the dimensions of the first smoke screen unit component 14, the second smoke screen 17 and a casing 11.

The first smoke screen component 14 can, for example, be what is called a decoy component, which burns rapidly and thereby produces a spontaneous smoke screen, and the second smoke screen component 17 can be a camouflage or masking component which burns slowly and thereby produces a long-lasting smoke screen. The long-lasting smoke screen can thereby be brought essentially into collocation with the spontaneous smoke screen at the target by means of a suitable selection of the ignition system as well as the landing system, which, as seen in FIG. 2, is also equipped with a parachute. In addition, the smoke screen produced by the combustion of the ammunition casing 11 can also advantageously be brought into collocation with the spontaneous smoke screen and the long-lasting smoke screen at the target, in order increase the complete smoke screen effect.

Although various minor modifications may be suggested by those versed in the art, it should be understood that we wish to embody within the scope of the patent granted hereon all such modifications as reasonably and properly come within the scope of our contribution to the art.

We claim:

1. In a smoke screen unit comprising a smoke screen component and a casing surrounding the component, the improvements comprising the casing comprising means to promote a uniform smoke screen effect during combustion of the smoke screen component without a chimney effect, said means comprising the casing being formed of a composite fiber material comprising fiber material and bonding agents, said composite fiber material being at least partially flammable and having a high strength, and said composite fiber material producing combustion reaction products composed of fiber materials comprising particles in the form of hydrocarbon $C_XH_Y$ which contribute to the smoke screen effect of the smoke screen unit during combustion thereof.

2. In a smoke screen unit according to claim 1, wherein the hydrocarbons $C_XH_Y$ have X>>Y and occur at a combustion temperature of the smoke screen unit in a range of 1500° C. to 2500° C.

3. In a smoke screen unit according to claim 2, wherein the combustion temperature is 2200° C.

4. In a smoke screen unit according to claim 1, wherein the density of the fiber material is in a range of 1.1 to 1.8 $g/cm^3$.

5. In a smoke screen unit according to claim 4, wherein the density of the fiber material is 1.36 $g/cm^3$.

6. In a smoke screen unit according to claim 1, wherein the density of the bonding agent is in a range of 1.0 to 1.3 $g/cm^3$.

7. In a smoke screen unit according to claim 6, wherein the density of the bonding agent is 1.15 $g/cm^3$.

8. In a smoke screen unit according to claim 1, wherein the strength of the fiber material is in a range of 0.8 to 3.0 $kN/mm^2$.

9. In a smoke screen unit according to claim 8, wherein the strength of the fiber material is 1.5 $kN/mm^2$.

10. In a smoke screen unit according to claim 1, wherein the ratio of the fiber material to the bonding agent is selected with the fiber material is in a range of 40 to 70 volume % of the total amount of material.

11. In a smoke screen unit according to claim 10, wherein the fiber material is in a range of 50 to 57 volume % of the total amount of material.

12. In a smoke screen unit according to claim 1, wherein the fiber material is selected from a group consisting of aramide, carbon fibers and carbon fibers doped with FeO.

13. In a smoke screen unit according to claim 1, wherein the fibers of the fiber material have a cross sectional diameter in a range of 30 $\mu$m to 60 $\mu$m.

14. In a smoke screen unit according to claim 13, wherein the cross sectional diameter of the fibers is 50 $\mu$m.

15. In a smoke screen unit according to claim 1, wherein the fiber material is a wound material wound around the casing.

16. In a smoke screen unit according to claim 1, wherein the fiber material is a wound material wound in a criss-cross fashion.

17. In a smoke screen unit according to claim 1, wherein the fiber material is wound material wound in a mesh pattern.

18. In a smoke screen unit according to claim 1, wherein the bonding agent is an epoxy resin.

19. In a smoke screen unit according to claim 1, wherein the bonding agent is an epoxy resin having a density in a range of 1.0 to 1.3 $g/cm^3$, the fiber material has a density of 1.1 to 1.8 $g/cm^3$ and a strength of 0.8 to 3.0 $kN/mm^2$, the ratio of the fiber material to the epoxy resin is selected with the fiber material being in a range of 40 to 70 volume % of the mass of the composite material.

20. In a smoke screen unit according to claim 19, wherein the fiber material is selected from a group consisting of aramide, carbon fibers and carbon fibers doped with FeO, said fibers of the fiber material have a cross sectional diameter in a range of 30 $\mu$m to 60 $\mu$m.

* * * * *